United States Patent [19]

Peckels et al.

[11] Patent Number: 4,519,587

[45] Date of Patent: May 28, 1985

[54] APPARATUS FOR REGULATING THE DELIVERY OF SOLID MATERIALS BY A BLOWING LANCE

[75] Inventors: Jean Peckels, Esch/Alzette; Antoine Schaaf, Soleuvre, both of Luxembourg

[73] Assignee: Arbed S.A., Luxembourg, Luxembourg

[21] Appl. No.: 544,073

[22] Filed: Oct. 21, 1983

[30] Foreign Application Priority Data

Oct. 27, 1982 [LU] Luxembourg ..... 84444

[51] Int. Cl.[3] ..... C21B 5/02

[52] U.S. Cl. ..... 266/80; 266/99; 266/216; 266/83

[58] Field of Search ..... 266/81, 82, 83, 216, 266/99, 80

[56] References Cited

U.S. PATENT DOCUMENTS

| | | | |
|---|---|---|---|
| 3,891,196 | 6/1975 | Forster et al. | 266/216 |
| 4,264,059 | 4/1981 | Benatar | 266/81 |
| 4,286,774 | 9/1981 | Benatar | 266/82 |
| 4,395,166 | 7/1983 | Ulveling | 266/81 |

*Primary Examiner*—L. Dewayne Rutledge
*Assistant Examiner*—S. Kastler
*Attorney, Agent, or Firm*—Fishman & Dionne

[57] ABSTRACT

An apparatus and process for rapidly injecting or blowing solid combustible material into a metal pool is presented. In a preferred embodiment, the apparatus essentially comprises at least one nonoxidizing compressed gas source, a circuit which supplies granulated carbonaceous material suspended in a carrier gas, at least one circuit which supplies flushing gas, various means for metering different flow rates of the gas and solid particulate streams and means for separately or jointly connecting the above described circuits to appropriate conduits which terminate in a blowing lance.

24 Claims, 1 Drawing Figure

APPARATUS FOR REGULATING THE DELIVERY OF SOLID MATERIALS BY A BLOWING LANCE

BACKGROUND OF THE INVENTION

This invention relates to the field of metal refining. More particularly, this invention relates to a new method and apparatus for regulating the delivery of solid materials from a lance to a pool of metal in a refining vessel, especially a pool of molten iron, during refining. The present invention discloses a process covering the introduction of combustible granulated material via neutral carrier gases into the refining metal.

Recarburization of metal by the addition of carbon from above the pool involves a variety of processes which are well known to those skilled in the art. For example, French patent application No. 2,459,835 discloses a process for blowing calcium carbide on the surface of an iron pool using refining oxygen as a vehicle for the carbide. According to French patent application No. 2,459,835, the carbide transported by the oxygen is surprisingly not oxidized in the jet. Unfortunately, recarburization reactions involving carbide compounds consume large quantities of energy, therefore severly limiting the practical application of the process due to high energy expense.

As an alternative to the energy expensive calcium carbide process described above, the carbon necessary for recarburization may be supplied in the form of anthracite, powdered coke or any other appropriate carbonaceous material. The insufflation (i.e., blowing onto the pool surface) of these other forms of carbon cannot adequately be carried out according to the method described in French patent application No. 2,459,835 without the occurrence of undesirably premature oxidation which could physically damage the operating equipment, such premature oxidation possibly being vigorous and even explosive. Consequently, the carbonaceous material must be injected in conjunction with a noncombustible or neutral carrier gas through utilization of a blowing lance, such as disclosed in Luxembourg application No. 84,433 corresponding to U.S. application Ser. No. 542,429 for "Device for Delivering Gaseous and Solid Materials to a Metal Pool During a Refining Process" filed Oct. 17, 1983, which is assigned to the assignee hereof and is incorporated herein by reference. It is also desirable that a protective screen between the flow of carbonaceous material and the adjacent jets of refining oxygen be provided such as described in said Luxembourg application No. 84,433.

It has been discovered that in order to achieve adequate absorption of the carbonaceous material into the pool, the pool must not only contain large concentrations of oxygen and carbon, but also sufficiently high kinetic energy which will enable the material blowing from the outlet of a lance to penetrate into the pool. This high kinetic energy, which is also required to avoid premature combustion of the carbonaceous material above the pool, is obtained through the mechanism of entraining the carbonaceous material in a powerful neutral gas flow. Unfortunately, this powerful jet of neutral gas has an undesirable cooling effect. This cooling necessitates that the carbonaceous material be blown into the pool in as short a time as possible. This short blowing time, in turn, necessitates a high concentration of solid material in the non-combustible carrier with resultant problems involving blockage in the various carrier gas flow conduits and in the blast pipe of the lance.

The necessity and concern for speed (i.e., minimizing the time) in recarburizing the metal pool is greatly increased if nitrogen is chosen as the carrier gas. It is apparent that the jet of nitrogen will strike the surface of the metallic pool coincident with the refining oxygen making contact therewith. This chemically active area of the pool is at an extremely high temperature. It is well known that the solubility of nitrogen in liquid steel increases with increasing temperature, the resultant costs of later recovering the dissolved nitrogen is therefore greater. Thus, as the time for recarburization increases the amount of nitrogen dissolved in the metal will increase; whereas the time for recarburization decreases, the amount of nitrogen dissolved in the bath will decrease.

SUMMARY OF THE INVENTION

The above discussed and other problems of the prior art are overcome or alleviated by the method and apparatus of the present invention. In accordance with the present invention, a process and device capable of rapidly injecting or blowing large quantities of granulated combustible material into a metal pool is presented. The present invention is particularly well suited for use during the refining of molten iron into steel.

The present invention comprises at least one source of a compressed gas, a circuit which supplies carbonaceous material suspended in a neutral gas (carrier gas), at least one circuit which supplies a flushing gas, various means for metering different flow rates of the gas streams and particulate carbonaceous materials, and means for separately or jointly connecting the above described circuits to appropriate conduits which terminate in a blowing lance.

The above-discussed and other advantages of the present invention will be apparent to and understood by those skilled in the art from the following detailed description and drawing:

BRIEF DESCRIPTION OF THE DRAWING

The single FIGURE of the drawing shows a schematic diagram of the apparatus in accordance with a preferred embodiment of the present invention.

DESCRIPTION OF THE PREFERRED EMBODIMENT

Figure 1:
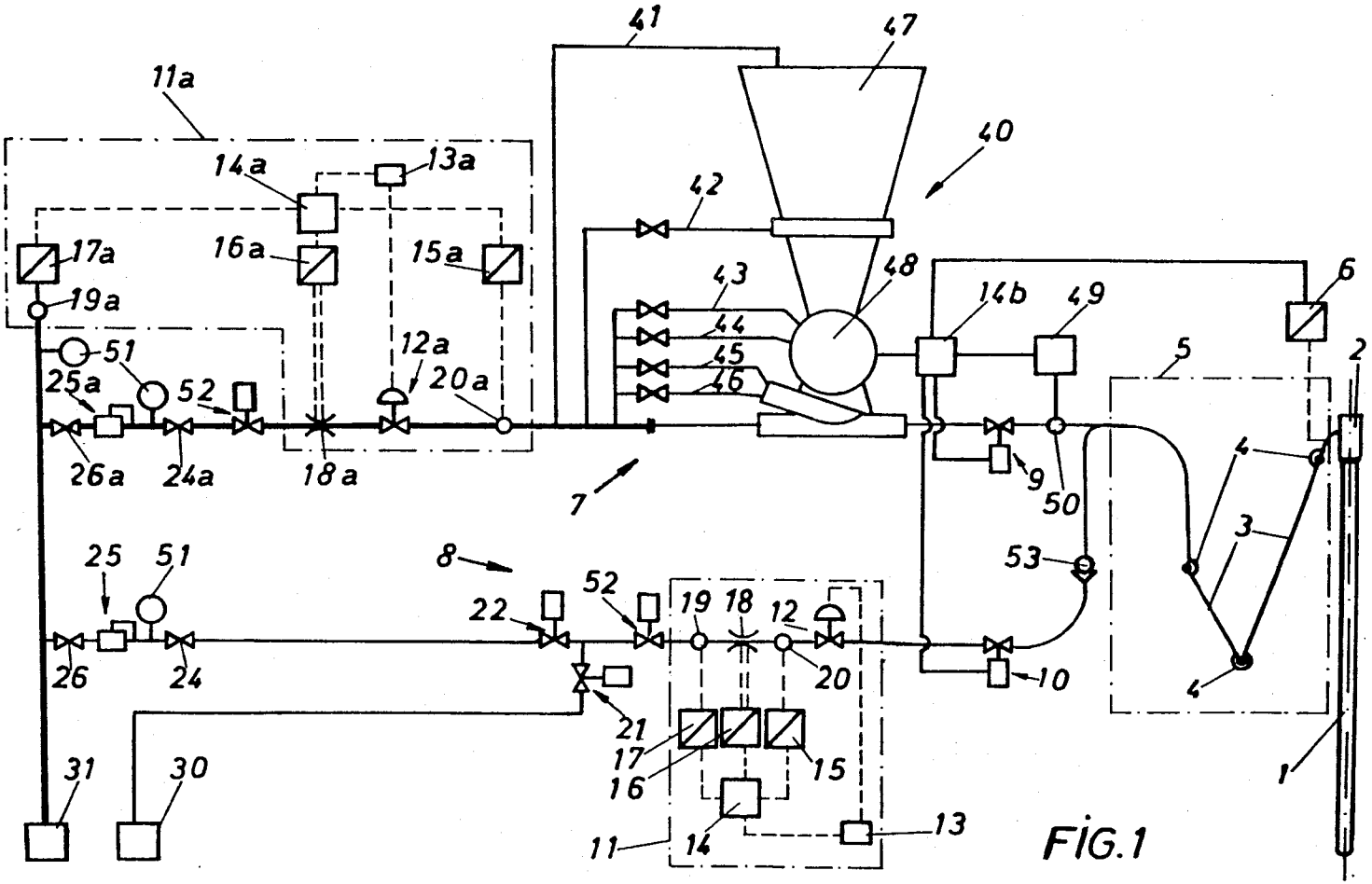

Referring first to FIG. 1, an apparatus for regulating the delivery of solid material to a lance is shown. The blowing lance is shown at 1 and may be a multiple-flow lance used to supply the pool concurrently with oxygen and granulated material. Alternatively, a conventiaion single-flow lance may be used to inject only the granulated material into the pool. In the latter case, the refining oxygen and possibly the post-combustion oxygen would be delivered through a separate lance. The lance 1 is mounted on a fast-positioning system 2, which is integral with a carriage, or any other mobile system (not shown) and is used to vertically position the lance a desired distance over the surface of the pool. The positioning system 2 is connected to an assembly 5 of rigid tubes 3 and hinges 4, conventionally known as shears, and a safety device 6 which detects possible leaks in the body of the lance 1. The detection of leaks is particularly important in those multiple-flow lances which simultaneously deliver the fuel (which is normally abrasive), and the combustion-supporting agent. For use in the present invention, a typical leak detector comprises a sheath filled with a liquid which surrounds the conduit of carbonaceous material in the lance, and a pressure detector which monitors the pressure of the liquid. In the event of a rupture, the detector records a change in pressure which it transmits to the safety device 6. The safety device 6, in turn, stops the blowing operation. A cooling circuit as described in Luxembourg patent application No. 84,433 corresponding to U.S. application Ser. No. 542,429 may also be utilized, so as to produce a simultaneous separation between the fuel and combustion-supporting agent conduits. As in the previously described leak detector, monitoring the pressure of the cooling circuit similarly permits a detection of leaks.

In a preferred embodiment, the shears 5 may be connected by electromagnetic valves 9 and 10, respectively, to the supply circuit 7 which supplies carbonaceous material to the lance 1, and/or to the flushing circuit 8 which supplies flushing gas.

The flushing circuit 8 is used to carry a predetermined flow of either argon originating from a source 30, or of nitrogen originating from a source 31 to the lance 1, by opening and/or closing the valves 21 or 22, respectively and by adequately controlling a flow regulator 11. The regulator 11 is essentially composed of a pressure sensor 19, a pressure variation sensor 18, and a temperature sensor 20, connected respectively to transducers 17, 16 and 15, which transform the sensed signals into electrical signals processable by the computer 14. The information processed by the computer 14 will determine the flow of flushing gas required as a function of the operation of the vessel or the state of blockage of the conduits; and the computer, in turn, transmits operating signals to a regulating valve 12 through an amplifier 13. It should be pointed out that for reasons of simplicity of illustration and not limitation, the computer has been illustrative at several different locations (see references 14*a* and 14*b*). Thus, while the distinct computers have been shown in FIG. 1, the present invention can equally be accomplished by using only one computer. Between the valve 22 and the nitrogen source 31 are valves 24 and 26 as well as a pressure regulator 25 which are positioned to prevent the nitrogen source 31 from exerting excessive pressure to the flushing gas supply 8. A unidirectional (e.g., check valve) valve 53 prevents any feedback from the supply circuit 7 of carbonaceous material to the circuit 8 supplying the flushing gas.

The supply circuit 7 which provides carbonaceous material is connected only to the nitrogen source (as opposed to the argon source) 31 and is essentially comprised of a flow regulator 11*a* and a fluidizing system 40 which has a reservoir or storage chamber 47 and cellular regulator 48. The cellular regulator has a well known construction including a cylindrical rotor metering wheel peripherally provided with plural vanes which define individual compartments or cells. The fluidizing system continuously varies the flow rate of the particular carbonaceous material to be introduced by regulatoring the rotational speed of the metering wheel of the cellular regulator 48. The flow rate of carrier gas passing through the blowing lance 1 can thus be modified independently of the quantity of solid material contained therein. The fluidizing system 40 is connected both to conduit 41 which carries pressurizing gas to the reservoir 47 of carbonaceous material, and to conduits 42 through 46 which supply gas to the fluidization system for the carbonaceous material. A sensor 50 monitors the pressure in the conduits downstream from the fluidizing system 40 and acts through transducer 49 and the computer 14*b*, to vary the speed of rotation of the cellular regulator 48.

The flow regulator 11*a* for the circuit 7 supplying carbonaceous material is of a similar design to that of regulator 11 controlling the flow of flushing gas. As a result, the elements performing equivalent functions are given the same reference numbers with the added letter a. It should be noted that the prevailing pressure in the conduit is monitored by the use of sensor 19*a* upstream from the pressure regulator 25*a* and valves 24*a* and 26*a*, sensor 19 seeing essentially the full pressure of the nitrogen source 31.

The preferred embodiment of the present invention also contains several conventional manometers 51 and electromagnetic valves 52. It will be obvious to those skilled in the art that instead of a single computer, individual computers, preferably analog computers, may also be used for the regulation of the flow rate of carrier gas, carbonaceous material, flushing gas, and to regulate the fluidizing system 40. In that case, the amplifiers 13 and 13*a* have been replaced by amplifier-regulators, which would receive their commands from the computer 14*b*, which would then control the concentration of solid material in the gas by acting on the amplifier-regulator 13*a*, and on the rotational speed of the wheel 48 of the cellular regulator 48. The computer 14*b* would then also be connected to the amplifier-regulator 13 to meter the flow of flushing gas. Supplementary coordination between the various elements of the installation can be provided by an operator.

The operation of the system of FIG. 1 is as follows:

During the recarburization phase, the valve 9 is opened while the valve 10 is closed. The flow rates of the carrier gas and the carbonaceous material are regulated to maximum values compatible with the capacities of the system (source, conduits, fluidizer, etc.) and the metallurgical requirements (capacity of the bath for the absorption of carbon, etc.). If the conduits indicate an incipient blockage, which can occur in the conduits located downstream from the fluidizer system 40, the pressure sensed by the sensor 50 increases, which will result in the computer 14 sending a command to reduce the rotational speed of the wheel of cellular regulator 48 so as to reduce the charge of solid material in the carrier gas flow. If the pressure continues to rise, an additional reduction of the speed of rotation is commanded. Thereafter, if the pressure drops, the rotational speed of the wheel of cellular regulator 48 is again increased. When successive reductions in the rotational speed of the wheel of cellular regulator 48 do not result in the clearing of conduits, the computer 14 commands the cessation of operation of the supply circuit 7, the closing of the valve 9, and the opening of the valve 10. The regulating valve 12 is then completely opened whereby nitrogen or argon (depending on the opening or the closing of the valves 21 and 22) is sent at high pressure to the shears 5 and the lance 1. If the desired clearing occurs, the pressure measured by the sensor 50 drops and the recarburization process may start again.

Between two recarburization operations, the valve 9 is closed and the valve 10 is opened whereby a weak flow of gas (either nigrogen or preferably argon) is allowed to circulate through the shears 5 and the lance 1 so as to prevent a blockage of the conduits from agglomeration of carbonaceous material deposited in the tubes, or a blockage of the lance head.

While the operation of the present invention has been described using neutral gas sources of either argon or nitrogen, it should be obvious to one skilled in the art that the use of any gas which is compatible with the particular chemical constraints of the system may be employed, i.e., any nonoxidizing gas, including recycled gas. As discussed above, the procedures involved in clearing the conduits have been described in terms of opening or closing the electromagnetic valves 9 and 10. It should be noted that the valves 9 and 10 can also be opened concurrently, with the different flow rates of gaseous and solid material adjusted so as to lead to the desired clearing. Still another alternative would permit the electromagnetic valve 10 to be commanded by pulses. In this latter case, it is necessary to choose the frequency and the rise time of the signals commanding the opening/closing of the valve 10 so as to avoid the creation of vibrations in the conduits or the appearance of excessive pressures which would be destructive to the equipment.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. An apparatus for regulating the delivery of solid combustible material through a blowing lance above a pool of metal comprising:

a source of a carrier gas;

supply circuit means for delivering solid combustible material suspended in said carrier gas to a blowing lance;

flushing circuit means for delivering flushing gas to said blowing lance;

means for controlling the flow rate of said solid combustible material to vary said flow rate over a range of operation;

means for controlling the flow rates of said carrier gas and said flushing gas to vary said flow rates of said carrier gas and said flushing gas over a range of operation; and means for connecting said supply circuit means and said flushing circuit means separately or concurrently to said blowing lance;

said means for controlling the flow rate of said solid combustible material including:

a fluidizing system, said fluidizing system having a rotating cellular regulator and a reservoir;

means for sensing conduit pressure downstream from said fluidizing system;

means for comparing said downstream pressure with a desired pressure and adjusting the speed of said rotating cellular regulator; and a plurality of conduit means connected to said fluidizing system carrying pressurized gas thereto.

2. An apparatus in accordance with claim 1 wherein said carrier gas and said flushing gas are nonoxidizing.

3. An apparatus in accordance with claim 2 wherein said nonoxidizing gas is nitrogen or argon.

4. An apparatus in accordance with claim 1 wherein said comparator means includes:

a computer communicating with said cellular regulator; and a transducer which links said computer and said pressure sensing means.

5. An apparatus in accordance with claim 1 wherein said carrier gas flow control means includes:

a pressure sensor;

a pressure variation sensor connected to said pressure sensor;

a temperature sensor connected to said pressure variation sensor; and a plurality of transducers one each of said transducers being connected to said pressure sensor, pressure variation sensor and temperature sensor whereby sensed signals are transformed into electrical signals processible by a computer.

6. An apparatus in accordance with claim 5 including a computer communicating with said transducers.

7. An apparatus in accordance with claim 5 including:

pressure regulator means connected to said carrier flow control means which prevents excessive exertion of pressure from said carrier gas source;

a plurality of valves preceding and exiting said pressure regulator means, said valves communicating with said pressure regulator means to regulate the pressure of said carrier gas source.

8. An apparatus in accordance with claim 1 wherein said solid combustible material is a carbonaceous material.

9. An apparatus in accordance with claim 8 wherein said carbonaceous material is selected from the group comprised of anthracite and powdered coke.

10. An apparatus in accordance with claim 1 wherein said flushing gas flow control means includes:

a pressure sensor;

a pressure variation sensor connected to said pressure sensor;

a temperature sensor connected to said pressure variation sensor; and a plurality of transducers, one each of said transducers being connected to said pressure sensor, pressure variation sensor and temperature sensor whereby sensed signals are transformed into electrical signals processible by a computer.

11. An apparatus in accordance with claim 10 including a computer communicating with said transducers.

12. An apparatus in accordance with claim 10 including:

pressure regulator means connected to said flushing gas flow control means which prevents excessive exertion of pressure from said flushing gas source;

a plurality of valves preceding and exiting said pressure regulator means, said valves communicating with said pressure regulator means to regulate the pressure of said flushing gas.

13. An apparatus in accordance with claim 1 including a plurality of valves, each of said valves communicating with a corresponding source of carrier and flushing gases.

14. An apparatus in accordance with claim 1 wherein said means for connecting said supply and flushing circuits to said lance includes:

a plurality of rigid tubes and associated hinges defining a shears, said hinged tubes connecting said supply and flushing circuit means with said lance.

15. An apparatus in accordance with claim 1 including a leak detector device whereby leaks are detected in said lance.

16. An apparatus in accordance with claim 1 including a vertical positioning system for positioning said lance.

17. An apparatus for regulating the delivery of solid combustible material through a blowing lance above a pool of metal comprising:

a source of carrier gas;

supply circuit means for delivering solid combustible material suspended in said carrier gas to a blowing lance;

flushing circuit means for delivering flushing gas to said blowing lance;

means for controlling the flow rate of said solid combustible material to continuously vary said flow rate over a range of operation;

means for controlling the flow rates of said carrier gas and said flushing gas to continuously vary said flow rates of said carrier gas and said flushing gas over a range of operation;

means for connecting said supply circuit means and said flushing circuit means separately or concurrently to said blowing lance;

said means for controlling the flow rate of said solid combustible material including:

a fluidizing system, and fluidizing system having a rotating cellular regulator and a reservoir;

means for sensing conduit pressure downstream from said fluidizing system;

means for comparing said downstream pressure with a desired pressure and adjusting the speed of said rotating cellular regulator; and a plurality of conduit means connected to said fluidizing system carrying pressurized gas thereto.

18. An apparatus in accordance with claim 17 wherein said comparator means includes;

a computer communicating with said cellular regulator; and a transducer which links said computer and said pressure sensing means.

19. An apparatus in accordance with claim 17 wherein said carrier gas flow control means includes:

a pressure sensor;

a pressure variation sensor connected to said pressure sensor;

a temperature sensor connected to said pressure variation sensor; and a plurality of transducers, one each of said transducers being connected to said pressure sensor, pressure variation sensor and temperature sensor whereby sensed signals are transformed into electrical signals processible by a computer.

20. An apparatus in accordance with claim 19 including a computer communicating with said transducers.

21. An apparatus in accordance with claim 19 including:

pressure regulator means connected to said carrier flow control means which prevents excessive exertion of pressure from said carrier gas source;

a plurality of valves preceding and exiting said pressure regulator means, said valves communicating with said pressure regulator means to regulate the pressure of said carrier gas source.

22. An apparatus in accordance with claim 17 wherein said flushing gas flow control means includes:

a pressure sensor;

a pressure variation sensor connected to said pressure sensor;

a temperature sensor connected to said pressure variation sensor; and a plurality of transducers, one each of said transducers being connected to said pressure sensor, pressure variation sensor and temperature sensor whereby sensed signals are transformed into electrical signals processible by a computer.

23. An apparatus in accordance with claim 22 including a computer communicating with said transducers.

24. An apparatus in accordance with claim 22 including:

pressure regulator means connected to said flushing gas flow control means which prevents excessive exertion of pressure from said flushing gas source;

a plurality of valves preceding and exiting said pressure regulator means, said valves communicating with said pressure regulator means to regulate the pressure of said flushing gas.

* * * * *